United States Patent [19]

Cupit

[11] Patent Number: 4,921,171

[45] Date of Patent: May 1, 1990

[54] SHOWER HEAD DISPENSER

[76] Inventor: Jerry D. Cupit, P.O. Box 121904, Nashville, Tenn. 37212

[21] Appl. No.: 379,060

[22] Filed: Jul. 13, 1989

[51] Int. Cl.[5] ..... B05B 7/24

[52] U.S. Cl. ..... 239/314

[58] Field of Search ..... 239/310, 314, 318, 345

[56] References Cited

U.S. PATENT DOCUMENTS

| | | | |
|---|---|---|---|
| 2,625,430 | 1/1953 | Murphy | 239/314 |
| 3,198,437 | 8/1965 | Faglie | 239/309 |
| 3,409,230 | 11/1968 | Eelkema | 239/314 |
| 3,623,638 | 11/1971 | Henning et al. | 239/314 |
| 3,907,203 | 9/1975 | Skillings | 239/418 |
| 4,131,232 | 12/1978 | Pollinzi | 239/314 |

*Primary Examiner*—Andres Kashnikow

*Assistant Examiner*—Karen B. Merritt

*Attorney, Agent, or Firm*—Harrington A. Lackey

[57] ABSTRACT

A shower head dispenser including a shower head mounted to discharge a water spray along a declining axis, a reservoir mounted on top of the shower head and having a discharge port immediately adjacent and alongside the spray outlet of the shower head and a mixer surface immediately below the discharge port, spaced from and parallel to the longitudinal spray axis of the shower head and disposed adjacent the periphery of the spray discharging from the shower head, so that the water spray from the shower head contacting the mixer surface mixes with any liquid, such as liquid soap, which has been discharged from the discharge port and adheres to the mixer surface.

4 Claims, 2 Drawing Sheets

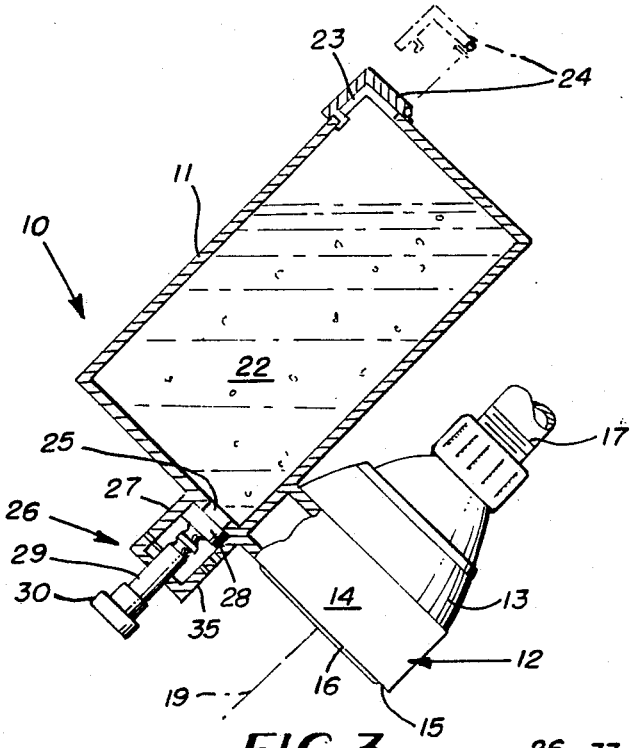
FIG. 3
FIG. 4
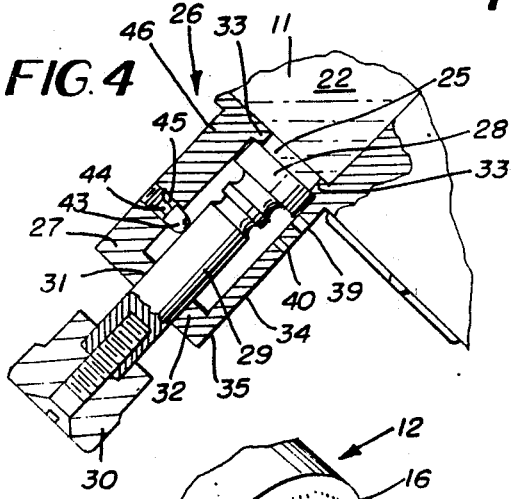
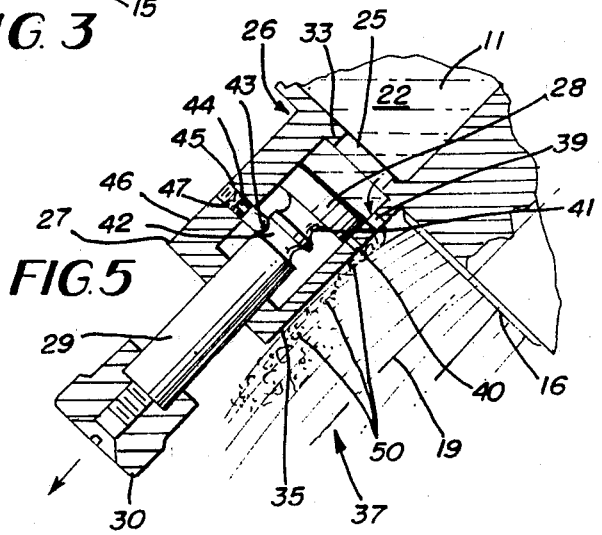
FIG. 5
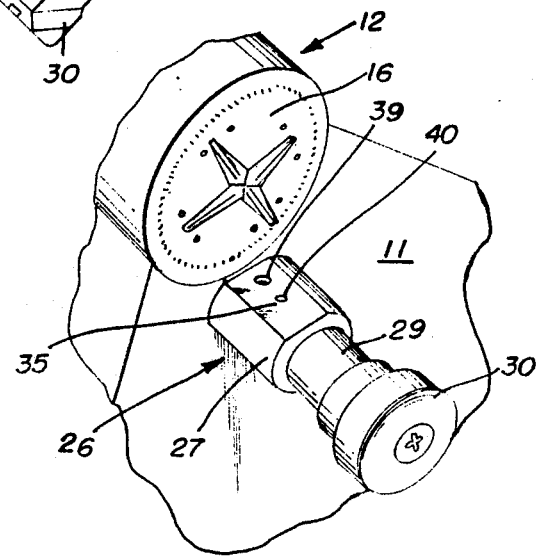
FIG. 6
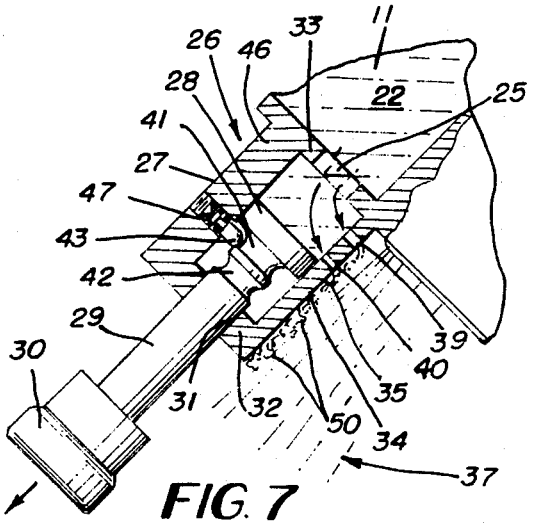
FIG. 7

SHOWER HEAD DISPENSER

BACKGROUND OF THE INVENTION

This invention relates to a shower head dispenser, and more particularly to the combination of a shower head and a liquid dispensing and mixing device.

The following U.S. patents disclose various types of liquid reservoirs attached to a water discharge outlet for dispensing liquid additives, such as soap, perfumes, disinfectants, bath oils, and water softeners, into the water stream discharged from the water outlet: U.S. Pat. No. 2,625,430: Murphy, Jan. 13, 1953; U.S. Pat. No. 2,705,091: Marchand, Mar. 29, 1955; U.S. Pat. No. 3,079,093: Bellows, Feb. 26, 1963; U.S. Pat. No. 3,198,437: Faglie, Aug. 3, 1965; U.S. Pat. No. 3,409,230: Eelkema, Nov. 5, 1968; U.S. Pat. No. 3,623,638: Henning et al., Nov. 30, 1971; U.S. Pat. No. 3,813,072: Moore, May 28, 1974; U.S. Pat. No. 3,907,203: Skillings, Sep. 23, 1975; U.S. Pat. No. 4,131,232: Pollinzi, Dec. 26, 1978.

All of the above patents, except Bellows, disclose such a reservoir and dispensing apparatus attached to a shower head.

The Skillings U.S. Pat. No. 3,907,203 discloses a shower head attachment in which a conduit discharges its liquid additive upon a diffuser 46 to facilitate mixing of the additive with the water stream from the shower head. Also, any liquid additive, such as soap, which might deposit upon the deflecting shield 42 would also be sprayed off and mixed with the discharging water stream. However, the diffuser 46 and the deflecting shield 42 in the Skillings device function as obstacles to the path of the discharging water spray to interfere with the spray pattern. Moreover, because of the force of the water spray, the small quantities of additives are more likely dispersed by the force of the spray, rather than being adequately mixed with the water.

Many of the other shower head dispensers disclosed in the above patents, such as Faglie, Moore, and Pollinzi, dispense the additives, such as liquid soap drops, directly into the middle of the spray, thereby subjecting the additives to the extreme force of the spray for dispersion instead of mixing.

None of the above patents disclose a dispenser incorporating a planar mixer surface spaced from and parallel to the longitudinal spray axis of the shower head and on the periphery of the spray pattern to permit contiguous impingement of the peripheral water spray droplets upon the mixer surface for thoroughly mixing with the additive liquid adhering to the mixer surface.

SUMMARY OF THE INVENTION

The shower head dispenser made in accordance with this invention includes a liquid reservoir or receptacle containing a liquid additive, such as liquid soap, mounted upon the upper portion of the shower head housing, and a discharge valve in the lower portion of the reservoir immediately adjacent and alongside the shower head outlet. The valve mechanism includes a discharge port projecting normal to the direction of water spray and an adjacent mixer surface for more adequately mixing the liquid additive with the water spray.

One object of this invention is to provide a shower head dispenser which is capable not only of distributing a liquid additive, such as soap, into the discharge water spray from the shower head, but also to produce a more homogeneous mixture between the liquid additive and the water spray.

The shower head dispenser made in accordance with this invention incorporates a declining planar mixer surface adjacent to the shower head and spaced above the longitudinal spray axis and contiguous with the water spray path. Liquid additive discharged through a port above and adjacent the mixer surface permits the liquid additive drops to adhere to the surface while moving down the mixer surface and in the peripheral path of the spray to afford a better mixture of the liquid additive and the water.

In a preferred form of the invention, the longitudinal spray axis of the shower head is at an acute angle to the horizontal, and preferably approximately 45 deg. The mixer surface is preferably disposed at the same angle parallel and above the longitudinal spray axis and contiguous with the spray discharge column, to permit the water spray to sweep the liquid additive droplets adhering to the mixer surface for thoroughly mixing the droplets with the water spray.

BRIEF DESCRIPTION OF THE DRAWINGS

FIG. 3 is a longitudinal sectional elevation taken along the line 3—3 of FIG. 1 of the reservoir and the valve dispensing mechanism in a closed position, with the shower head shown partially in section;

FIG. 4 is an enlarged fragmentary sectional elevation of the lower portions of the reservoir and the shower head and the valve dispensing mechanism, in a closed position;

FIG. 5 is a fragmentary sectional elevation view similar to FIG. 4, with the valve dispensing mechanism in a first open position discharging the liquid additive;

FIG. 6 is a fragmentary, bottom, front perspective view of the shower head, the valve dispensing mechanism and the mixer surface; and FIG. 7 is a fragmentary sectional elevation similar to FIG. 4, with the valve dispensing mechanism in a second open position.

DESCRIPTION OF THE PREFERRED EMBODIMENTS

Figure 1:
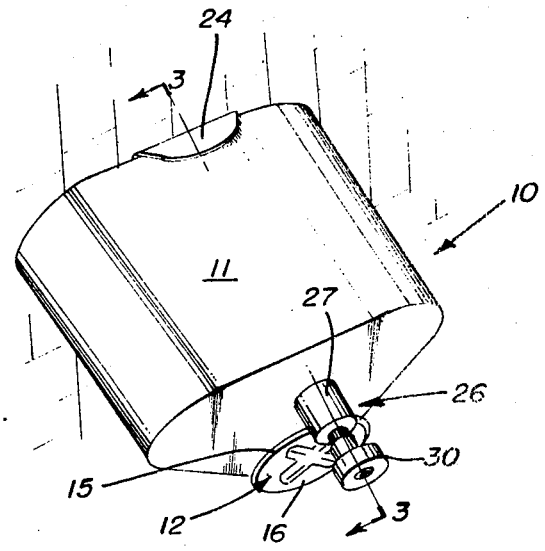
FIG. 1 is a top front perspective view of the shower head dispenser made in accordance with this invention.
Figure 2:
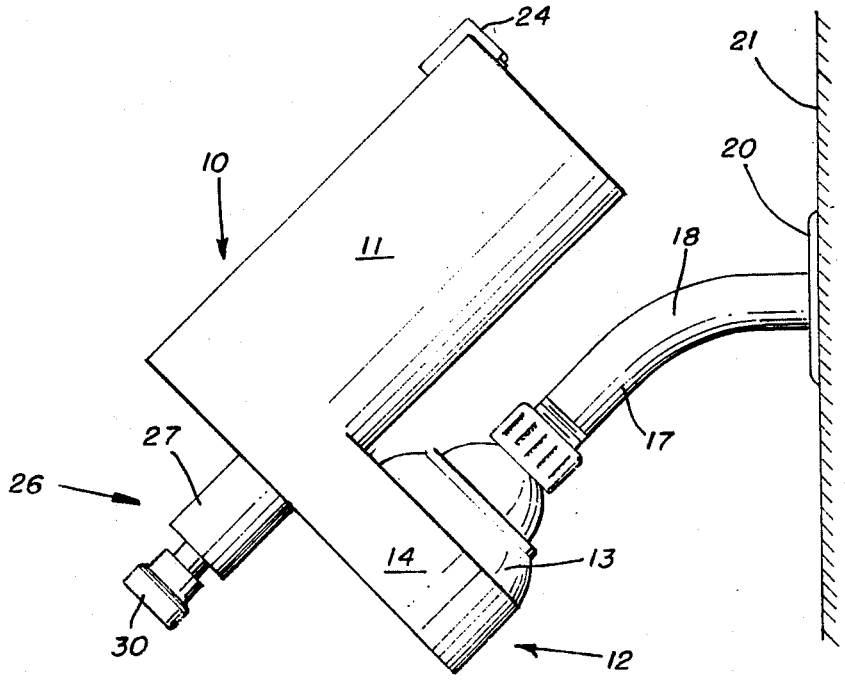
FIG. 2 is a side elevational view of the shower head dispenser disclosed in FIG. 1.

Referring now to the drawings in more detail, the shower head dispenser apparatus 10 made in accordance with this invention includes a liquid reservoir or container 11 supported upon a shower head 12. The shower head 12 may be of a conventional type including a generally conical-shaped housing 13 having a lower cylindrical housing portion 14 including a bottom discharge outlet 15 into which is mounted a spray diffuser plate 16, which may be adjusted to discharge spray columns of various patterns. The upper end of the shower head housing 13 is coupled to a water supply pipe 17 including an angular bend 18 positioning the longitudinal spray axis 19 of the shower head 12 at about 45 deg. to the horizontal. The upper portion of the supply pipe 17 is supported by a mounting plate 20 (FIG. 2) upon a vertical wall 21, such as the wall of the shower.

The liquid reservoir 11 may be of any desired shape, size or volume, such as that disclosed in the drawings, for receiving a liquid additive, such as liquid soap 22, in a sufficient quantity to furnish the desired amount of soap for a predetermined number of shower baths.

The upper portion of the reservoir 11 is provided with a liquid inlet 23 covered by a snap-fastening closure member 24, or any other desired cover or closure member, such as a hinged closure member, not shown.

The bottom portion of the reservoir 11 is provided with a liquid outlet 25.

In liquid communication with the outlet 25 is a valve dispensing device or mechanism 26 including a tubular chamber or housing 27 slidably receiving a valve member 28. The valve member 28 is mounted on the end of a valve stem 29, the opposite end of which terminates in a valve operator, such as a knob 30. The stem 29 is slidably received within an annular opening or hole 31 in the lower end wall 32 of the tubular housing 27. The axial movement of the valve member 28 is limited by the lower end wall 32 and the upper end wall 33 of the tubular housing 27.

The lower or bottom wall 34 of the tubular housing 27 has a lower outer planar mixer surface 36 which extends the length of the tubular housing 27, as best illustrated in FIG. 6. This planar mixer surface 35 is spaced above and parallel to the longitudinal axis 19 and is adjacent and contiguous to the upper periphery of the discharge spray column 37 (FIG. 5).

Formed through the lower housing wall 34 is one or more discharge ports, such as the first discharge port 39 and the second discharge port 40 smaller than, and below, the first discharge port 39. Each of these discharge ports has a flow axis which is normal to the longitudinal spray axis 19. Both of the discharge ports 39 and 40 are preferably located toward the upper end of the tubular housing 27, as illustrated in the drawings.

Formed on the valve stem 29 below the valve member 28 are a pair of axially spaced annular detent grooves 41 and 42. Each of the detent grooves 41 is adapted to register with a detent 43 supported for radial reciprocable movement by a detent stem 44 within a corresponding hole 45 in the top wall 46 of the tubular housing 27. The detent 43 is urged axially inward into engagement with the stem 29 or its corresponding grooves 41 and 42 by a small coil spring 47 (FIG. 7).

The annular detent grooves 41 and 42, as well as the discharge ports 39 and 40, are so axially spaced and positioned that both ports are closed when the valve member 28 registers with or is above the first discharge port 39, as illustrated in FIGS. 3 and 4. In this closed position, the detent 43 does not engage either of the detent grooves 41 or 42, but rides on the cylindrical surface of the valve stem 29, as best illustrated in FIG. 4.

However, when the knob 30 is retracted or pulled downwardly a sufficient distance for the valve member 28 to clear the first discharge port 39, but still close the second discharge port 40, as illustrated in FIG. 5, the valve member 28 will be held in this position by the engagement of the detent 43 with the lower annular groove 42, also disclosed in FIG. 5. By further retracting the knob 30 downward, the valve member 28 is lowered sufficiently to expose both of the first and second discharge ports 41 and 42, with the detent 43 registering and engaging the upper annular groove 41, as best illustrated in FIG. 7.

If desired, a third annular groove could be located in radial alignment with the detent 43 when the valve member 28 is in its closed position, disclosed in FIG. 4.

Also it is within the scope of this invention to have only a single discharge port with the valve member 28 being either in a closed position or an open position for the single discharge port.

The size of the liquid discharge port 39, that is its diameter, as well as its length, the declining angle of the mixer surface 35, as well as the viscosity and the liquid head of the liquid additive 22, will determine the degree to which the liquid 22 flows through the discharge port 39. Preferably, the above parameters are such that the liquid 22 will discharge slowly in a thin stream, or even in droplets 50, to permit the liquid droplets 50 to adhere to and move downwardly along the mixer surface 35, as illustrated in FIG. 5, by molecular attraction. Since the planar mixer surface 35 is long relative to the size of the discharge ports 39 and 40 and relative to the distance between the water spray outlet 15 and the discharge port 39, it is possible for a substantial amount of the additive liquid droplets 50 to adhere to the mixer surface 35 before being swept therefrom by the periphery of the water spray 37. The periphery of the water spray 37 is not as massive or as forceful as the central portion of the water spray. Accordingly, the liquid droplets 50 will tend not only to be carried by the peripheral water spray, but also to mix thoroughly with the water spray before the spray is discharged upon the bather.

The elongated planar mixer surface 35 prevents the liquid additive 50 from being directly discharged into the main force of the water stream 37 where it is likely to be dispersed before it can be adequately mixed with the water in the spray column 37.

As disclosed in FIG. 7, the liquid additive 50 may be increased by opening the second discharge port 40, or even additional discharge ports, not shown, if desired.

The operation of the apparatus 10 is apparent from the above description. When the bather is standing beneath the shower head 12, he turns on the valve, not shown, permitting water to be discharged through the pipe 17 and the shower head 12 in a spray column 37, determined by the adjustment of the diffuser plate 16. After the temperature of the water is adjusted by the appropriate valves, not shown, and when the bather is ready to introduce a liquid additive, such as liquid soap 22, into the spray column 37, the bather pulls the knob 30 in the direction of the arrow disclosed in FIG. 5 to open the discharge port 39. The liquid additive 22 then flows through the outlet 25 into the tubular housing 27 and out through the discharge port 39.

Since the planar mixer surface 35 is disposed at a declining angle from the horizontal, such as 45 deg., and is parallel to the longitudinal spray axis 19, and extends beyond the discharge port 39, the liquid droplets 50 tend to adhere to, and move downward along, the mixer surface 35, as illustrated in FIG. 5. When the liquid droplets 50 descend far enough that they are in the path of the peripheral water droplets of the spray column 37, the liquid droplets 50 are swept in a path parallel to the longitudinal planar mixer surface 35 to break the adhesion of the liquid droplets 50 from the mixer surface 35 and to gradually be mixed in with the water of the spray column 37. By the time the water and the liquid droplets 50 descend far enough to fall upon the bather, they are adequately mixed, so that the soap/-water mixture may immediately be applied to the skin of the bather, without further mixing.

Whenever it is desired to terminate the discharge of the liquid 22 from the reservoir 11, the knob 30 is pushed upward causing the valve member 28 to move upward to its inoperative position closing the discharge port 39.

When the bather decides to use more liquid or soap 22, he pulls the knob 30 further down to the position disclosed in FIG. 7, causing the valve member 28 to open both discharge ports 30 and 40. The droplets 50 discharged through both ports 30 and 40 move down the planar mixing surface 35 where they are gradually mixed with the water drops from the periphery of the spray 37 in the same manner as the droplets 50 discharged through the single port 39.

What is claimed is:

1. A shower head dispenser comprising:

(a) a shower head having a water inlet and a water spray discharge outlet, (b) said shower head having a longitudinal spray axis extending in the direction of the water spray discharged from said outlet, (c) means mounting said shower head so that said discharge outlet faces downward and said spray axis declines at an acute angle from the horizontal, (d) a liquid reservoir mounted on said shower head above said longitudinal axis, said reservoir having upper and lower portions, said reservoir having a liquid inlet in said upper portion and a liquid outlet in said lower portion, (e) valve means in fluid communication with said liquid outlet, comprising a discharge port spaced above said longitudinal axis and alongside the water spray stream discharged from said water spray discharge outlet, and a movable valve adapted to open and close said discharge port, and (f) an elongated planar mixer surface immediately below and adjacent said discharge port, said mixing surface being substantially parallel to and spaced above said longitudinal spray axis and extending along the edge of and in contiguous contact with the water spray stream discharged from said discharge outlet, whereby the periphery of said water spray mixes with any liquid discharged from said discharge port and adhering to said mixer surface.

2. The invention according to claim 1 in which said shower head comprises an annular housing, said reservoir mounted on said annular housing, said valve means comprising a tubular valve housing having a longitudinal axis parallel to said longitudinal spray axis, said mixer surface comprising the bottom surface of said valve housing.

3. The invention according to claim 2 in which said valve is longitudinally movable within said valve housing for opening and closing said discharge port.

4. The invention according to claim 2 in which said discharge port extends through the upper portion of said mixer surface, said discharge port having a discharge axis substantially normal to said longitudinal spray axis.

* * * * *